United States Patent [19]

Kraft et al.

[11] Patent Number: 5,033,151

[45] Date of Patent: Jul. 23, 1991

[54] CONTROL AND/OR INDICATION DEVICE FOR THE OPERATION OF VACUUM CLEANERS

[75] Inventors: Manfred Kraft, Neubulach; Gerhard Kurz, Stuttgart, both of Fed. Rep. of Germany

[73] Assignee: Interlava AG, Lugano, Switzerland

[21] Appl. No.: 437,432

[22] Filed: Nov. 15, 1989

[30] Foreign Application Priority Data

Dec. 16, 1988 [DE] Fed. Rep. of Germany ..... 3842320
Apr. 29, 1989 [DE] Fed. Rep. of Germany ..... 3914306

[51] Int. Cl.[5] ..... A47L 9/28

[52] U.S. Cl. ..... 15/319; 15/339; 15/412

[58] Field of Search ..... 15/319, 339, 412

[56] References Cited

U.S. PATENT DOCUMENTS 4,163,999 8/1979 Eaton et al. ..... 15/319 X
4,370,776 2/1983 Kullik ..... 15/319
4,399,585 8/1983 Kullik et al. ..... 15/319

*Primary Examiner*—Chris K. Moore
*Attorney, Agent, or Firm*—Darby & Darby

[57] ABSTRACT

A device for controlling the operation of a vacuum cleaner and for signalling the dust bag fill level, the existence a clogged pipe or of secondary air openings, or the like has an air turbine arranged in the exhaust air flow generated by the blower of a vacuum cleaner, downstream of the dust bag, whose rotary speed or the air turbine is detected in a non-contact manner, converted into an electric indication signal and supplied to a control circuit which controls the blower motor. Based upon the rotary speed so detected, it is then possible to determine the momentary operating conditions of the vacuum cleaner and/or the dust bag fill level, to emit signals warning the operator that the dust bag has to be changed, and also to display finely graded percentage statements or applicable text messages for the user. By combining this information with pressure values picked up by diaphragm-type switches, it is possible to accurately determine the operating conditions to be indicated.

13 Claims, 1 Drawing Sheet

CONTROL AND/OR INDICATION DEVICE FOR THE OPERATION OF VACUUM CLEANERS

BACKGROUND OF THE INVENTION

The present invention relates to a device for controlling and signalling the operation of vacuum cleaners.

In a known device of this kind (DE-OS 30 30059), a vacuum cleaner which is to be controlled so that a constant rate of air flow is maintained, has a small air turbine arranged in its intake area. This air turbine serves as the sole external sensor and drives a tachometer which generates a control voltage that must be rectified. The control voltage is supplied to a phase control for the blower motor of the vacuum cleaner so that when the rate of air flow decreases, the phase control causes the output of the electric motor driving the blower of the vacuum cleaner to increases.

If the rate of air flow through the vacuum cleaner exceeds the preset constant air flow, the phase control acts to reduce the power of the blower motor.

However, a problem of this known device is that the air turbine is located in the path of the air flow drawn in by the vacuum cleaner, which, of course contains dust particles. These dust particles cannot be eliminated, not even by making the surfaces in the air turbine area as smooth as possible. Thus dust particles will gradually accumulate in certain areas and restrict the air passage. The dust particles, which may in some cases contain or consist of greasy or so liquid substances, will eventually limit or generally restrict the air passage, at least in the mechanical turbine area, to such an extent that the air turbine can no longer function properly, or so that considerable inaccuracy in the measured results will occur.

This problem is further aggravated by the fact that the air turbine drives a tachogenerator, in the form of an electric generator, with the blade element mounted on the shaft driving a generators rotor.

The operation of an air-flow sensor such as that described above, is necessarily problematic because power is required for driving the generator, for example, in order to overcome the friction between the collector and the carbon brushes and, generally, in order to induce the desired electric voltage in the stator windings via the rotating magnetic fields.

Consequently, the air flow sensor is neither non-reactive nor capable of providing true and correct information on the actual rate of air flow. The sensor itself interferes with the accuracy of the measured rate by its behavior and is, therefore, not capable of providing sufficiently exact results in areas of low air flows. This is due to the two reasons described before, i.e. clogging by dust particles, which leads to changes in the measured results due to aging, and undesirable frictional effects in the rotor area.

In order to enable a vacuum cleaner to be controlled so that a constant air flow rate is maintained or, correspondingly, a constant vacuum, it has also been known (DE-OS 24 43 945), to arrange a plurality of push buttons directly at the vacuum cleaner, for manual operation. These push buttons interlock each other and produce a mechanical effect only insofar as they act as a bypass to introducing additional air into the vacuum area of the vacuum cleaner so that the vacuum which is produced can be regulated in increments. The vacuum produced remains constant within larger limits by taking in amounts of additional air corresponding to the drop in the air flow rate, which would normally be described as secondary air. However, such a device requires that the bypass air flaps, normally arranged in the handle of the vacuum cleaner, be set by the operator to the correct position manually and this normally cannot be expected.

Normally, it would seem desirable to have the operation of the vacuum cleaner controlled largely automatically and to spare the operator the required decisions. The operator would then, conveniently, only have to determine certain desired properties, for example, the nature of the floor or the desired power setting (soft stage; maximum stage). The vacuum cleaner would then be controlled according to these preset values or operate along corresponding characteristics, in which case it may also be convenient to have the blower of the vacuum cleaner controlled by microprocessors, minicomputers or similar regulating or control components which are finding more and more acceptance in the field of household appliances.

However, to ensure perfect operation, such logical control centers require very comprehensive actual-value information including, if possible, information on the actual fill level of the dust bag, information on clogged pipes or secondary-air openings, or the like. The availability of this information permits the central control element to inform the operator accordingly, for example via a suitable display at the vacuum-cleaner body.

For indicating the fill level of the dust bag of a vacuum cleaner it has further been known (DE-PS 27 12 201 and DE-PS 28 35 473) to provide pressure switches reacting to pressure variations, usually in the form of minimum pressure governors, especially in the air intake area of the vacuum cleaner, and to advise the user, by externally visible pilot lamps, at least when the dust bag must be changed.

The fundamental principle of the fill level indication for vacuum cleaners is that as long as the dust bag is empty or only partially filled, a vacuum prevails in the area of the vacuum cleaner, basically at any point. A pressure difference sufficient for the intended measuring and indication purposes exists between this vacuum and the vacuum prevailing with a full or empty dust bag, provided a sufficiently sensitive pressure sensor or a pressure switch is used. In detail, the process may operate in such a way that the vacuum generated by the blower of the vacuum cleaner with an empty or partially filled dust bag is comparatively low. The air drawn in for cleaning purposes, for example through the floor brush of the vacuum cleaner, still has a comparatively free passage through the dust bag, so the resulting vacuum is only low, at high velocity, i.e. only a little below the atmospheric pressure, for example.

This situation changes, however, as the dust bag gradually becomes clogged, whereby a constantly increasing resistance to air flow is built up leading to a clear rise in vacuum at the motor side. As a result thereof, the work output of the vacuum cleaner drops altogether, as the higher vacuum prevails only in the area between the dust bag and the blower of the vacuum cleaner, not between the floor brush and the dust bag, for example. Consequently, the air-flow volume and the vacuum prevailing at the floor brush drop in this area.

Sufficiently sensitive diaphragm minimum pressure governors are capable of detecting safely the resulting pressure differences which, regarded alone and in absolute values are extremely small, for example in the range of approx. 25 mbar, between the empty and full dust bag, and of causing a signal to be generated when the dust bag is full or almost full. Then, the dust bag can be changed as required, it being simultaneously ensured that full use can be made of the cleaning possibilities provided by the vacuum cleaner and that environmental disturbance is minimized.

However, certain problems may be encountered with special types of vacuum cleaners when for some reason or other the vacuum difference between the empty and the full dust bag is either extremely small or missing and noticed only when the dust bag is already excessively full, or when in case of such vacuum cleaners, which anyway react critically to pressure measurements, producing excessively small pressure differences due to their particular design, it is desired to indicate additional peripheral marginal conditions, for example clogged pipes or a larger secondary-air opening, for example if the housing of the vacuum cleaner has not been fully closed.

It is the object of the present invention to provide control means for a vacuum cleaner which includes means for indicating the operational behavior of the vacuum cleaner and which ensures its controlled operation within a broad sensitivity range.

The invention solves the above mentioned problems with the aid of the characterizing features of claim 1 and provides the advantage that by measuring the air flow rate directly a primary actual value connected with the operation of the vacuum cleaner is used for interpreting its working conditions. It is possible, due to the sensitivity of the measurement, to obtain very exact measurements over the full working range of the vacuum cleaner when the air flow rate is, of small or extremely small. This information for regulate the operation of the vacuum cleaner and/or to indicate it to the user by optical and/or acoustic means.

It is, therefore, particularly advantageous to arrange a propeller for directly detecting the air-flow rate, i.e. responding to the incoming air flow, in the exhaust air flow of the vacuum cleaner, i.e. downstream of the dust bag and the blower of the vacuum cleaner. This area may be additionally calmed by intermediate filters. Since the air channel through the vacuum cleaner is enclosed on all sides, the exhaust air must be a true mirror image of the supply air flow drawn in. Consequently, the propeller element must also be in a position to react with particular sensitivity to a broad range of air-flow conditions prevailing in the vacuum cleaner so that it is possible, for example, to also indicate the fill level of the dust bag as percentage values, for example by means of a 7-segment luminous indication or a thin-film crystal indication.

According to one preferred embodiment of the present invention, the propeller can rotate freely and is arranged in the exhaust air flow of the vacuum cleaner, with the least possible frictional resistance. The frictional resistance in this embodiment results only from propeller's own support. The rotary movement of the propeller is recorded in a non-contact manner and converted into an electrical signal. This ensures that a true image of the exhaust air flow rate, even in the case of extremely low velocities, is supplied in the form of an electric signal sequence. It is made possible in this case, by supporting the propeller element in a suitable manner, to operate practically in a non-reactive manner, i.e. without any frictional effects. This can be achieved, for example, by using suitable plastic bearings or ball bearings support the propeller element or turbine wheel either centrally or from both sides, and by picking up the rotary movement separately, in a non-contact manner, for example via a light barrier arrangement which picks up and responds to the passage of a disk moving in the air current.

Non-contact scanning of the rotary movement of the propeller element can be achieved also by the use of other systems, operating, for example, on an inductive or capacitive basis (approximation switches), or by the use of Hall generators.

It is thus possible, in a very advantageous manner, to generate an output signal varying linearly with the exhaust air flow rate. This signal can then be evaluated in a suitable manner.

Since the measured air-flow rate (and the pressure conditions) of the vacuum cleaner are directly related to values such as the fill level of the dust bag, clogged pipes, open vacuum cleaner housings, and the like, it is possible, with the aid of the output voltage generated by the propeller element, to draw conclusions regarding the operating conditions of the vacuum cleaner prevailing at any given time. Consequently, it is also possible to define a threshold value for determining the moment when the flow rate recorded by the propeller element of the exhaust air sensor has dropped to a value indicating that the dust bag is full or almost full, in which case the fact that the dust bag has to be changed will be indicated. A similar effect, i.e. drop of the exhaust air flow rate, will be produced by clogged pipes so that this condition, too, can be detected by the air turbine. The opposite condition, namely an excessively high exhaust air flow rate, may occur, for example, when no dust bag is in place or when secondary air is introduced. This condition can also be recorded and evaluated, by use of suitable threshold means to provide a visual or acoustic signal which may include additional information on the prevailing pressure obtained by additional measurements.

According to an advantageous improvement of this embodiment, luminous diodes may be used for supplying a so-called YES/NO indication, by using suitable colors, for example red for the indication "defective or full dust bag" and green for "undisturbed operation".

The features described by the dependent claims permit additional advantageous improvements and further developments of the control and indication device for the operation of a vacuum cleaner. A particularly advantageous solution may be obtained by the simultaneous use of suitable pressure sensors at suitable points in the air passage, i.e. upstream of the dust bag, between the dust bag and the blower, or downstream of the blower in the exhaust air area, for deriving additional actual-value information in the form of vacuum values, which is then supplied to a central control circuit. The latter may then determine, for example automatically, whether or not the given fill level requires the immediate change of the dust bag or if the power loss can still be compensated by increasing the blower output, which would then have to be effected as required. It would also be possible in this connection for the control circuit, which would preferably comprise a microprocessor, to switch over the vacuum cleaner to different operating conditions as a trial, and to compare the actual values (air turbine output voltage and/or the pressure values supplied by pressure sensors) with stored values for deriving conclusions as to the actual condition of the vacuum cleaner. The conclusions arising from this comparison can then be used either for regulating the operation of the vacuum cleaner or for providing the operator with the corresponding information.

A vacuum cleaner equipped in this manner is capable either of regulating itself automatically to a constant air-flow rate or of adapting itself automatically, within the limits of predetermined power values or along predetermined characteristics, to the properties of the floors to be cleaned, which may also be determined by the vacuum cleaner automatically, with the additional possibility to have corresponding values preset by the user, for example if he wants to clean curtains, deep-pile carpets, plain linoleum floor coverings, or the like.

BRIEF DESCRIPTION OF THE DRAWING

One embodiment of the invention will be described hereafter in more detail with reference to the drawing in which.

DESCRIPTION OF THE EMBODIMENTS

A basic idea of the present invention involves arranging a propeller element downstream of the motor blower and of the dust bag, i.e. in the exhaust-air flow, regardless of the relative arrangement of these two main units in the vacuum cleaner, and generating, by non-contact scanning of the rotary movement of the propeller element, an output signal linearly proportional to the air-flow rate. This out signal is then utilized for regulating the vacuum cleaner in combination with additional information from pressure sensors provided at predetermined points in the air passage of the vacuum cleaner, if necessary or desired.

Figure 1:
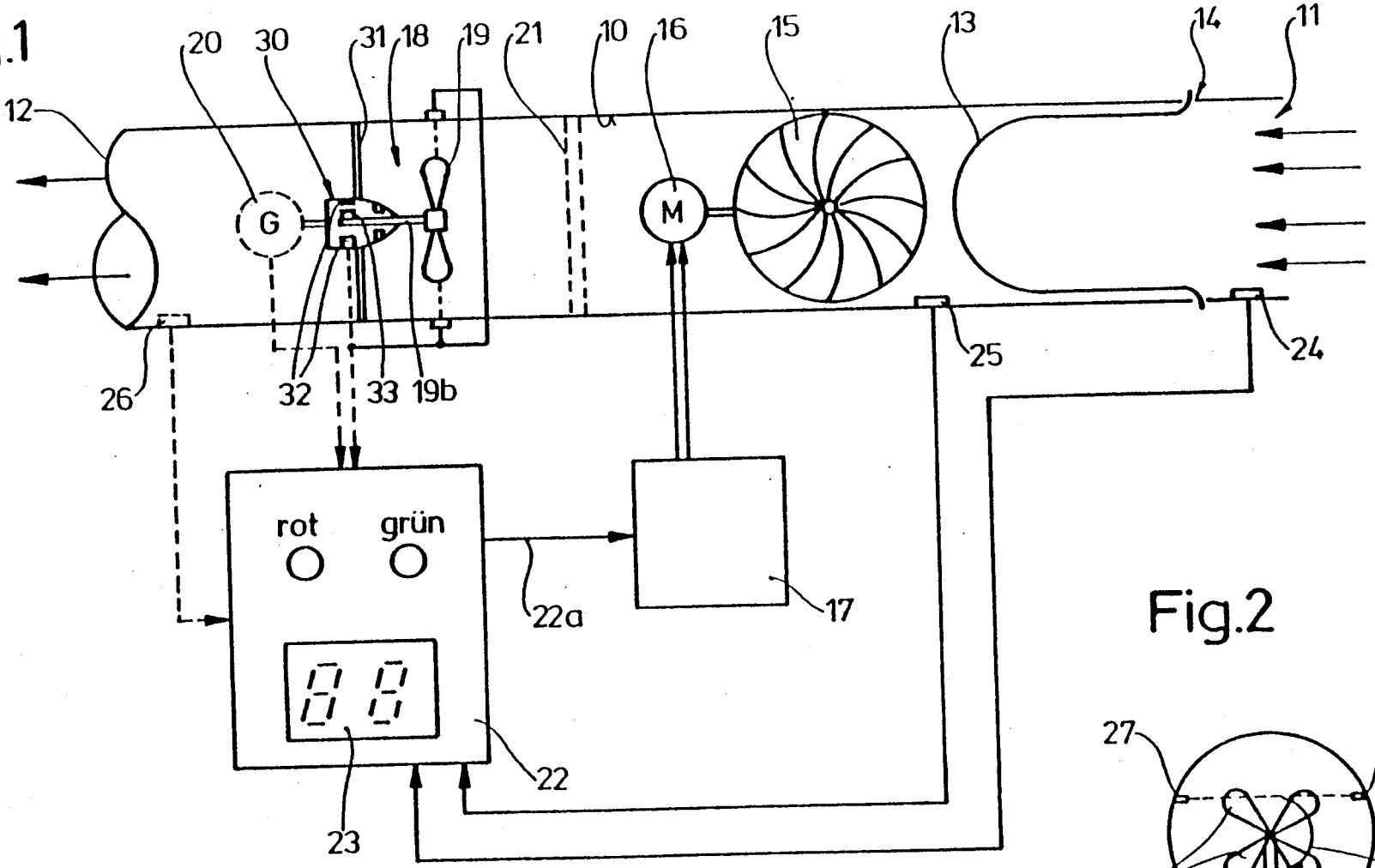
FIG. 1 is a diagrammatic representation of the air passage area of a vacuum cleaner, which in this case exhibits a tubular shape, with the motor blower and an exhaust-air sensor arranged downstream of the dust bag and the motor-driven blower.

Regarding now FIG. 1, the passage formed by the vacuum cleaner, and through which the air current is produced, is designated generally by reference numeral 10. It comprises an inlet 11 and an air outlet 12 leading out of the vacuum cleaner. Further, a dust bag 13, indicated diagrammatically in the drawing, is mounted in a suitable dust-tight manner at 14. In the case of the embodiment shown in the drawing, the motor blower 15, which is driven by a suitable electric drive motor 16, is arranged downstream of the dust bag. A motor control 17, which is designed to operate in a suitable manner and which preferably comprises a phase control, enables the drive motor 16 to be operated with the desired power output, which may vary within broad limits.

Downstream of the described two partial units, i.e. the dust bag 13 and the blower 15 of the vacuum cleaner including its drive, there is an exhaust air sensor 18 in the form a propeller element 19.

Figure 2:
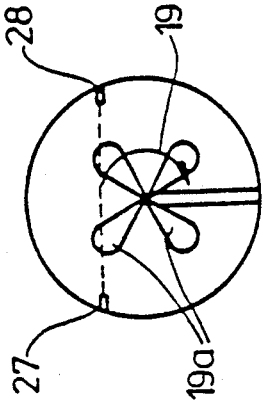
FIG. 2 is a diagrammatic representation of one possible embodiment of the exhaust-air sensor with optical scanning and a (reflex) light barrier.

FIG. 2 shows a possible first embodiment of an arrangement designed for generating an electric signal proportional to the exhaust-air flow. The embodiment comprises a propeller element 19—indicated diagrammatically in the drawing—which is supported in the exhaust air flow of the vacuum cleaner by a suitable supporting element. It goes without saying that the propeller element may have any desired structure. It is only important that the necessary partial elements be arranged in the air current in such a manner that an air flow will cause the propeller element to rotate. The propeller element may, therefore, be designed in the form of a propeller, as shown in FIGS. 1 and 2, or in the form of an axial blower. For the purposes of the present description, the term "propeller element" will be used to describe all possible embodiments of such an element.

Given the fact that any propeller element comprises blade portions spaced from each other, or to say it by more general terms, that there are always passage openings in the propeller element, a non-contact scanning device may be arranged at this point. The scanning device depends on these passage openings or spacings for information on the rotary movement of the propeller element in any desired manner, for example, this by detecting the passage of the blade elements **19*a* by optical sensors 27, 28** (transmitters, receivers).

According to a preferred embodiment, however, which is shown in more detail in FIG. 1, a fully enclosed housing 30 is arranged in the exhaust air passage, which housing accommodates the propeller element 19 whose shaft **19*b*** penetrates through the housing wall in sealed relationship and is supported therein in a suitable manner, conveniently by means of ball bearings.

The housing itself may have a streamlined front and is connected to and supported on the inner wall of the exhaust air passage by some cross-bars 31.

For picking up the rotary movement of the propeller element 19, a disk is mounted on the shaft **19*b* introduced into the housing 31. This disk rotates together with the shaft and may itself include passage openings or holes scanned in a suitable manner by non-contact optical sensors 32. These sensors may either comprise light transmitters or light receivers, which may also be suited for infrared light, or, of course, for a reflex light barrier. Alternatively, it is also possible to replace the disk by a lug mounted on the rotary shaft 17*b* and moving together with the propeller, which movement is then scanned, likewise in a non-contact manner. It goes without saying that other sensors may be used here; too, for example, inductive or capacitive sensor elements whose electric behavior is varied periodically in response to the rotary speed of the propeller element 19 by the passage of the blade or disk 33 mounted on the shaft. The blade or disk may also comprise a magnetically permeable material or be equipped with magnets. Consequently, it would also be possible to mount a small permanent magnet on each of the blade portions or on the shaft 19*b*** carrying the propeller element. The permanent magnet would then be scanned by a Hall generator or another element responding to electromagnetic effects. Alternatively, it would also be possible to arrange such a permanent-magnetic element on one of the blades, in which case a Hall generator arranged adjacent the pipe wall would then pick up the revolution frequency of the air turbine.

Downstream of the motor control 17, and there is provided a control and indication block 22 which may also contain the central electric or electronic logic circuit mentioned before, e.g. a microprocessor, for evaluating the different actual-value signals supplied to it by pressure sensors 24, 25 and 26 and for deriving from these values the—regulated—operation of the motor control 17 for the blower drive motor 16, preferably by means of a phase control.

The indication portion of the control block 22 may comprise a suitable optical indication means, for text indications conveying different messages (dust bag full, pipe clogged, main air duct of the vacuum cleaner open, vacuum cleaner functioning properly (or the like), or if desired, the indication portion may consist of indicators simple YES/NO for example, of a red and green luminous diode, the red luminous diode indicating some malfunction and the green luminous diode indicating that the vacuum cleaner is functioning properly. Finally, the indication may also include a numerical percentage indication reflecting the fill level of the vacuum cleaner, using for example the FIGS. 0 to 100 and usual optical indication means, such as a 7-segment luminous diode indication or a liquid crystal indication 23.

The control block 22 comprises, preferably, a plurality of circuits for predetermining electric threshold values which, being generally known, need not be described here in greater detail. These circuits usually comprise operational amplifiers with a properly biased resistor combination for the reference voltage. The threshold value circuits evaluate the incoming actual value signals and are capable of converting them into corresponding signals suitable for being processed by the microprocessor or the control circuit. The control circuit may also contain window discriminators whose output signals may be used for keeping the air flow passing through the inner dust bag passage, constant by driving a phase control in a suitable manner in the control circuit.

If, for example, the exhaust air flow rate picked up by the propeller element 19 remains below a predetermined value even when the blower output is increased by the central control circuit (microprocessor), then this has to be interpreted as an indication of an overfilled dust bag, and a corresponding optical/acoustic indication will appear reminding the operator that the dust bag has to be emptied. If the dust bag is not emptied, then the control circuit may even switch off the motor control 17 altogether, in order to avoid possible damage in this area or to the blower motor.

An advantageous embodiment of the present invention may also be obtained when measurement of the exhaust air flow is combined with pressure measurements at different points of the main air passage 10 of the vacuum cleaner. Such an arrangement allows accurate detection of operating conditions which would lead is to several possible interpretations even if the measurement is made only of the exhaust air flow rate. For the purpose of performing the pressure measurements, diaphragm-type pressure switches may be arranged, for example, in the area of the intake opening at 24 and/or between the dust bag and the blower at 25, or even in the exhaust air passage at 26.

The control block 22 may further comprise sample-and-hold circuits, in which case the values or messages previously indicated are further displayed even after the vacuum cleaner has been switched off and the air turbine no longer operates. This effect can also be achieved by storage means. In this connection, the most diverse embodiments are rendered possible by modern miniaturized storage technology.

Consequently, the evaluation circuit in the control block 22 is also capable of combining the measured exhaust-air values supplied to it with the recorded pressure values. If, for example, a pipe should be clogged, then this trouble is located upstream of the pressure sensor 24 (diaphragm switch) so that a high vacuum value occurs at this point, practically independently of the fill level of the dust bag, whereas the air turbine may at the same time indicate only a low exhaust-air flow rate. The evaluation circuit may then interpret the closed diaphragm switch 24 and the low voltage value encountered upstream of the generator 20 as a clogged pipe, with the aid of usual circuit means, such as gates, inverters or window discriminators, which need not be described here in more detail. Although it is, of course, also possible, and even advantageous, to make use of microprocessors, or the like, for this purpose.

In contrast, a full dust bag only leads to a low vacuum value in the area of the pressure switch 24 which, may be designed as a multi-step switch reacting to different pressures with different switch positions. In this case, too, the exhaust air flow rate is small and the generator output voltage is correspondingly small.

If, in contrast, a secondary air opening exists, then one obtains a low vacuum pressure value at the switch, but a high exhaust air flow rate.

All the features shown in the drawing and described in the specification and the following claims may be essential to the invention either alone or in any combination thereof.

We claim:

1. A device for controlling the operation of a vacuum cleaner, having a blower (15) driven by a motor for creating an air flow, a dust bag, an exhaust air passage, and an air turbine arranged for generating an output signal proportional to the air flow rate and a supply means for supplying the signal to a control circuit controlling the motor, characterized in that said air turbine (19) with a shaft mounted for rotation is located in the exhaust air flow of the vacuum cleaner, downstream of the blower (15) and the dust bag (13), and non-contact scanning means are provided for detecting the rotary movement of the air turbine without contact with the turbine and without contact with the shaft of the turbine and converting the detected movement into an electric output signal.

2. A device according to claim 1, wherein said air turbine (19) includes a closed housing (30) having a propeller element located in the exhaust air passage, the propeller element having a rotary shaft with a perforated disk mounted thereon for non-contact scanning by a sensor means.

3. A device according to claim 2, wherein the non-contact sensor is an optical sensor in the form of a light transmitter and a light receiver which detects the perforations of the disk (33) mounted on the shaft of the propeller element to derive therefrom a signal representative of the air volume passing through the exhaust air passage.

4. A device according to claim 1, wherein a light-barrier means (27, 28) detects the rotating blade portions (19*a*) of the air turbine (19).

5. A device according to claim 1, wherein inductive sensor means is provided for non-contact scanning of the rotary movement of the air turbine (19).

6. A device according to claim 1, further including an indicator means for indicating the operating condition of the vacuum cleaner, the indicator means comprises a display means.

7. A device according to claim 6, wherein a text display means provides messages regarding the operating condition of the vacuum cleaner.

8. A device according to claim 1, wherein pressure sensor means are provided on other locations in the main passage of the vacuum cleaner and output signals of the pressure sensor means are employed with the output signal of the air turbine, to distinguish between vacuum cleaner operating conditions.

9. A device according to claim 1, wherein an output signal indicating excessive clogging of the vacuum cleaner main passage is supplied to the control circuit for switching off the motor.

10. A device according to claim 1, wherein a control means (22) comprises a microprocessor for controlling the motor via a phase control within predetermined limits in response to actual-value signals applied to the control means by a non-contact exhaust-air sensor (18) and pressure sensor means and in response to any commands supplied to the control means manually by the operator with respect to power output.

11. A device according to claim 1 further including means for generating an upper threshold value for the air turbine output signal and means for generating a low threshold value for the air turbine output signal.

12. A device according to claim 1, wherein capacitive sensor means is provided for non-contact scanning of the rotary movement of the air turbine (19).

13. A device according to claim 1, wherein magnetic sensor means is provided for non-contact scanning of the rotary movement of the air turbine (19).

* * * * *